US007361096B2

(12) United States Patent
Sanchez

(10) Patent No.: US 7,361,096 B2
(45) Date of Patent: Apr. 22, 2008

(54) WATERSLIDE

(75) Inventor: Terry Sanchez, Vacaville, CA (US)

(73) Assignee: Wham-O, Inc., Emeryville, CA (US)

( * ) Notice: Subject to any disclaimer, the term of this patent is extended or adjusted under 35 U.S.C. 154(b) by 14 days.

(21) Appl. No.: 11/376,517

(22) Filed: Mar. 14, 2006

(65) Prior Publication Data

US 2006/0160631 A1 Jul. 20, 2006

Related U.S. Application Data

(63) Continuation of application No. 10/779,265, filed on Feb. 13, 2004, now abandoned.

(60) Provisional application No. 60/356,452, filed on Feb. 11, 2002.

(51) Int. Cl.
*A63G 21/18* (2006.01)

(52) U.S. Cl. ..... 472/117; 472/128

(58) Field of Classification Search ..... 472/116–129; 104/69, 70

See application file for complete search history.

(56) References Cited

U.S. PATENT DOCUMENTS 1,789,885 A * 1/1931 Skinner ..... 193/2 R
3,830,492 A * 8/1974 Deveau et al. ..... 472/116
4,198,043 A * 4/1980 Timbes et al. ..... 472/117
5,135,440 A * 8/1992 Smollar et al. ..... 472/128
5,154,671 A * 10/1992 Smollar et al. ..... 472/117
5,453,054 A * 9/1995 Langford ..... 472/88
5,478,281 A * 12/1995 Forton ..... 472/117
5,551,922 A * 9/1996 Katz et al. ..... 472/117
5,839,964 A * 11/1998 Rudell et al. ..... 472/117
5,865,679 A * 2/1999 Seabolt et al. ..... 472/117
6,045,449 A * 4/2000 Aragona et al. ..... 472/117
6,062,983 A * 5/2000 Butsook ..... 472/117
6,186,902 B1 * 2/2001 Briggs ..... 472/117
6,375,578 B1 * 4/2002 Briggs ..... 472/117
6,413,165 B1 * 7/2002 Crandall et al. ..... 472/117

* cited by examiner

*Primary Examiner*—Kien Nguyen
(74) *Attorney, Agent, or Firm*—James A. Fox; John M. McCormack, Esq.; Heller Ehrman LLP

(57) ABSTRACT

A slide is provided with a sliding surface along which a person may slide. The slide includes a bridging structure spanning the sliding surface and a valve mounted to the bridging structure and coupled to a source of water. A spray nozzle is selectively coupled through the valve to the water source. The spray nozzle is mounted to the bridging structure to spray water toward the sliding surface when the valve couples the nozzle to the water source. A trigger hangs from the bridging structure adjacent the sliding surface and controls the valve to direct water to the spray nozzle when the trigger is contacted and displaced by the user. The nozzle sprays water onto the user as the user activates the trigger by sliding under the bridging structure.

23 Claims, 3 Drawing Sheets

WATERSLIDE

CROSS-REFERENCE TO RELATED APPLICATIONS

This application is a continuation of U.S. patent application Ser. No. 10/779,265, now abandoned filed Feb. 13, 2004 which claims priority to U.S. patent application Ser. No. 10/365,701, filed on Feb. 11, 2003 and to U.S. Provisional Patent Application Ser. No. 60/356,452, filed Feb. 11, 2002, the disclosures of which are incorporated herein by reference.

FIELD OF THE INVENTION

The present invention relates generally to a waterslide providing a path on which a user slides. More specifically, the invention relates to a waterslide that sprays water onto the user while the user slides along the waterslide path.

BACKGROUND OF THE INVENTION

Waterslides on which a user slides have been known for several years. For example, Wham-O, Inc.'s SLIP'N SLIDE® waterslide has been used for years by children to cool off, in an entertaining way, on warm summer days. Such waterslides typically include a path formed of a rectangular sheet of plastic with a sprinkler tube along side the sheet to sprinkle water onto the path to lubricate it.

SUMMARY OF THE INVENTION

The present invention includes a children's toy waterslide incorporating a sliding surface, a trigger, and a spray nozzle controlled by the user to spray water onto the user as the user slides past the trigger. Water typically is sprayed along the length of the sliding surface by a sprinkler tube at all times while the slide is in use. The spray nozzle may be controlled by the trigger to spray only as the user passes the trigger, thus providing an additional play pattern to the typical sliding scenario.

BRIEF DESCRIPTION OF THE DRAWINGS

FIG. 6 is a partially cutaway top plan view of the bridging structure, showing the coupler for connecting to the garden hose, a valve for routing water through a secondary hose to the sprinkler tube and selectively through the tube to the spray nozzle, the valve, hoses and tubes being shown as if the front span of the bridging structure were see-through.

DETAILED DESCRIPTION AND BEST MODE OF THE INVENTION

Figure 1:
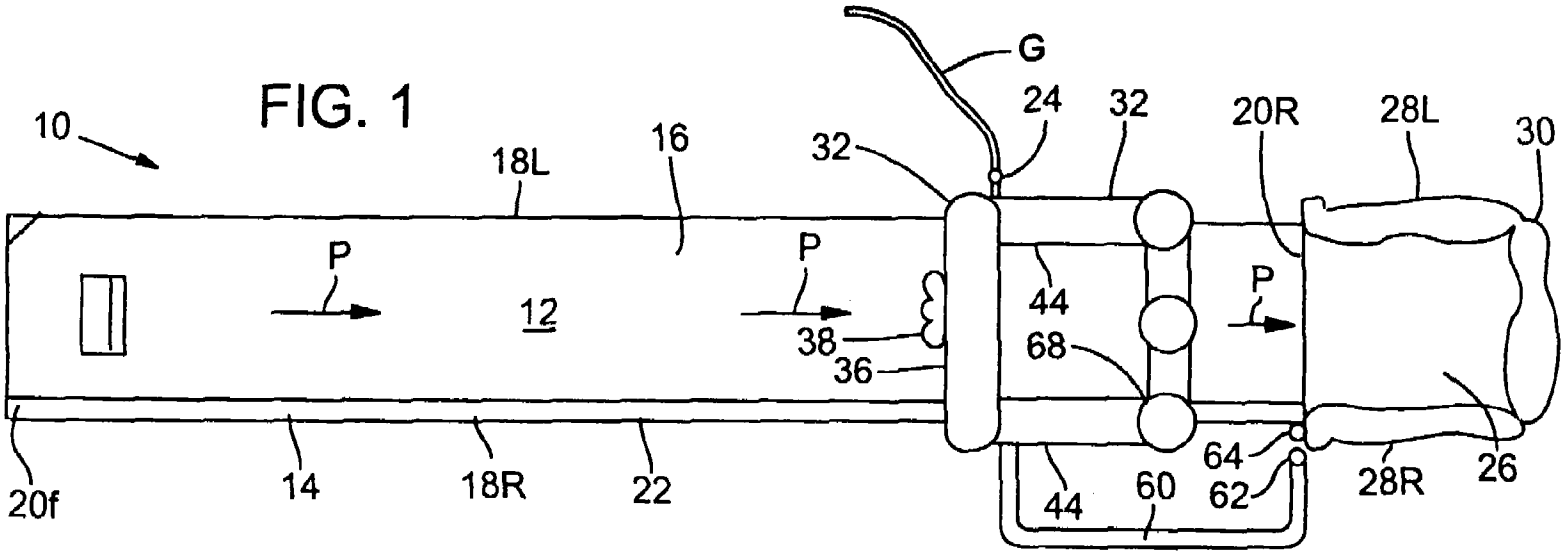
FIG. 1 is a top plan view of a waterslide in accordance with an embodiment of the present invention, showing the sliding surface, a sprinkler tube alongside the sliding surface, a bridging structure spanning the sliding surface, a connection to a garden hose, a hose coupling for the sprinkler tube, a tube extending back to a spray nozzle, and a U-shaped end basin for the slide.

A children's toy waterslide constructed according to the present invention is shown in FIG. 1, and indicated generally at 10. Waterslide 10 includes a sliding surface 12 and a sprinkler tube 14. Typically the sliding surface is formed of a sheet 16 of plastic of any suitable material, preferably one with a low coefficient of friction when wetted with water. A typical length and width for the sheet is about 222-inches by about 34.2-inches, and any suitable length and width may be used. Sheet 16 is typically rectangular in shape with elongated sides 18L and 18R and shorter ends 20F and 20R, or other shapes may be incorporated. Waterslide 10 is typically for use on a substantially flat, soft surface, such as a grass lawn, which is either level or gently sloping downward from the front end toward the rear end.

As shown, sprinkler tube 14 is formed along only one side 18R of sheet 16, but alternatively may be formed along both sides or located in other positions suited for wetting down surface 12 through an array of holes 22 in sprinkler tube 14, preferably at least about 120 holes arranged in groups of three, spaced along the sprinkler tube. For example, the groups of three holes may be spaced about 5.6-inches apart and holes within the groupings of three may be spaced about 0.5-inches.

A user slides on the slide when wet by running toward the front end 20F, leaping onto the sliding surface 12, and sliding in the direction of the rear end 20R along a path in a direction P on the sliding surface. The waterslide is wetted, e.g., by connection to a source of water, such as garden hose G, through a hose coupler 24, typically female. Hose coupler 24 is connected, as described more fully below, to sprinkler tube 14. Water from hose G thus flows out through holes 22 in sprinkler tube 14, preferably continuously while the slide is in use, wetting sliding surface 12.

Figure 5:
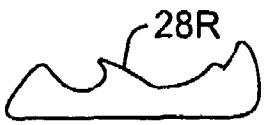
FIG. 5 is a side elevation of the U-shaped end basin of the waterslide, showing the flame-shaped contours of an inflatable structure that forms the end basin.

An end basin 26 is provided adjacent rear end 20R of sheet 16, typically of the same type of plastic as sheet 16 and integrally formed with sheet 16. End basin 26 includes two side walls 28R and 28L and an end wall 30, forming a U-shaped basin which tends to hold a small pool of water. The walls may be inflatable structures and may be formed in fanciful shapes, e.g., the flame shapes best seen in FIG. 5. Typically the end basin is about 42-inches in length and about the same width as the sliding surface, but other sizes and shapes may be used.

A structure, such as bridging structure 32, that extends over or overhangs, or that is otherwise adjacent sliding surface 12 is positioned at a location between front end 20F and rear end 20R of sliding surface 12. Bridging structure 32 is shown at a location closer to rear end 20R, and may be located anywhere along sliding surface 12 or in end basin 26. Bridging structure 32 may be movable relative to sheet 16, fixed in place on sheet 16, or removably affixed, for example, by Velcro® fasteners. Bridging structure 32 typically spans sliding surface 12 and also extends along the user's path. For example, bridging structure 32 may extend along the path about 40-inches, or any other chosen distance.

Bridging structure 32 is preferably made of inflatable plastic compartments, which may be separate and have individual inflation valves or interconnected with fewer valves or a single valve. Bridging structure 32 typically includes a pair of front legs 34L and 34R, and a beam or span 36 interconnecting the legs. A bumper 38 may be mounted on the front of span 36 for reasons which will become apparent.

A trigger 40 is suspended from span 36 adjacent sliding surface 12. Typically trigger 40 is sized and positioned so that the user sliding along the path will contact the trigger and displace the trigger along the path. Preferably trigger 40 will swing out of the way of the user, who will then pass underneath the trigger and the bridging surface. Preferably trigger 40 is an inflatable plastic structure.

Bridging structure 32 also may include two pairs of upper and lower inflatable sections 44 that extend along the path to a rear section 46 of bridging structure 32. Rear section 46 typically includes a pair of legs 48L and 48R, and a rear beam or span 50 interconnecting the rear legs.

Trigger 40 controls a spray nozzle 52, which is mounted to rear span 50 of bridging structure 32. Spray nozzle 52 is disposed above sliding surface 12 and positioned to spray water downwardly toward the sliding surface when the user activates the trigger, e.g., by contacting the trigger and displacing the trigger along the path. Typically the user will be sliding past the trigger and the spray nozzle so that water from the spray nozzle sprays onto the user.

Figure 7:
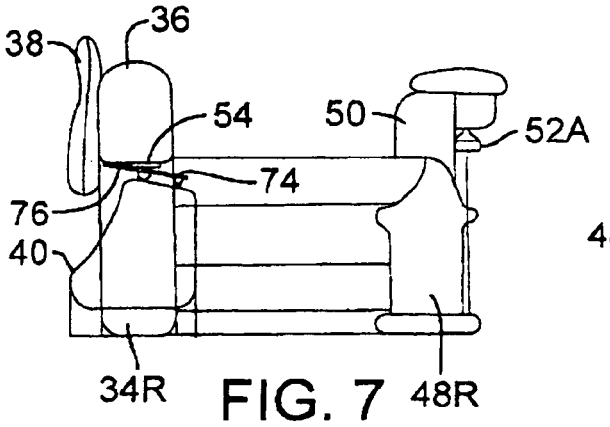
FIG. 7 is a side elevation of the bridging structure showing the valve and its connections to the trigger as if the leg of the bridging structure were see-through, and also showing an alternative embodiment for the spray nozzle.
Figure 8:
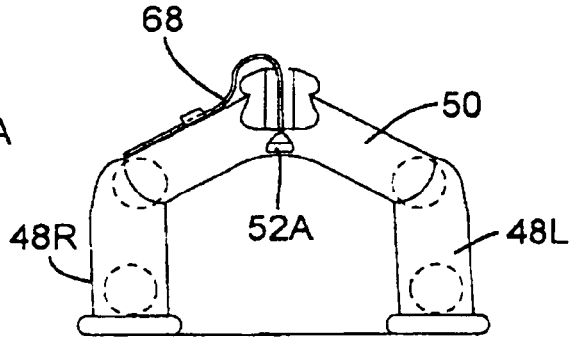
FIG. 8 is a rear elevation of the bridging structure showing the alternative embodiment for the spray nozzle of FIG. 7.

The trigger typically remains in the active position until after the entire body of the user has passed the trigger. Preferably the spray nozzle is placed along the path a distance from the trigger so that any delay times in turning on and off the valve (to be described below) are accounted for any the spray from nozzle 52 is on for the period roughly corresponding to when the user is passing beneath the spray nozzle. Typically the spray nozzle is positioned farther in the direction of the user's sliding along the path than the trigger by at least about 10-inches, and preferably by about 40-inches, and other distances may be used for a desired play characteristic and for selected valve characteristics. Spray nozzle 52, which may be formed of hard plastic, is typically surrounded by the inflatable portions of rear span 50. A different embodiment for a spray nozzle 52A is shown in FIGS. 7 and 8.

Figure 6:
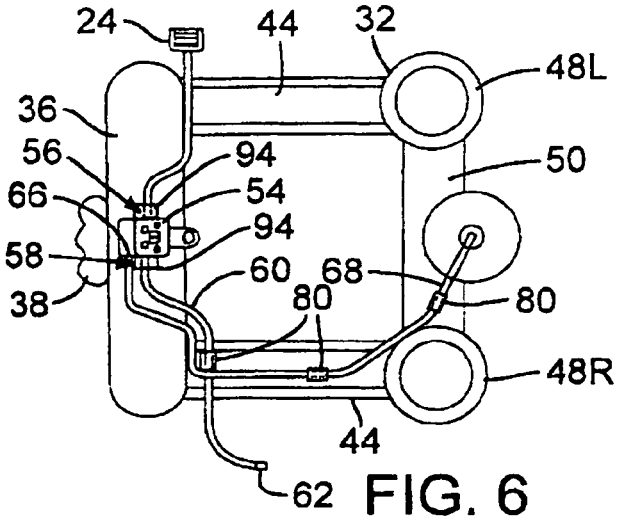

As best seen in FIG. 6, a valve 54 may be mounted to span 36 of bridging structure 32 e.g. by encasing valve 54 in an envelope 90 that is sealed to bridging structure 32 at edges 92, and by placing connectors 56 and 58 under retaining clips 94. Valve 54 may be connected to hose coupler 24 at an input connector 56. Valve 54 preferably provides a connection that preferably is always on to an output connector 58 that is connected to an extension hose 60 for coupling to sprinkler tube 14. As shown in FIG. 1, hose 60 may include a coupler 62 for connecting to a coupler 64 on sprinkler tube 14.

While the components of bridging structure 32 are preferably made of inflatable plastic compartments, which reduces the chance of injury by a user mistakenly sliding into the structure, valve 54 is typically made of a hard plastic. Thus bumper 38 is positioned in front of valve 54 to cushion any contact between the user and the valve.

Figure 2:
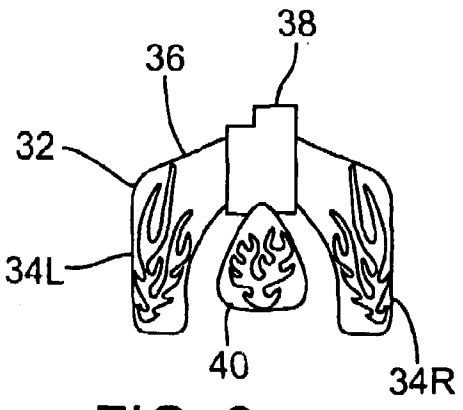
FIG. 2 is a front elevation of the bridging structure of the slide showing a trigger hanging from the bridging structure, and the inflatable front legs and span of the bridging structure.
Figure 3:
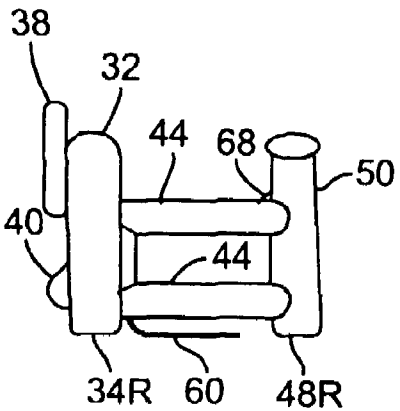
FIG. 3 is a side elevation of the bridging structure of the slide showing the trigger in the front, and the hose leading back along the inflatable side portions of the bridging structure to the spray nozzle in the rear portion of the bridging structure.
Figure 4:
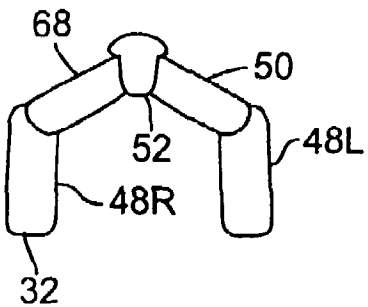
FIG. 4 is a rear elevation of the bridging structure of the slide showing the inflatable rear legs and rear span supporting the spray nozzle.

Valve 54 preferably includes a second output connector 66 which is not always on, but rather selectively provides water to the spray nozzle under the control of the trigger. While trigger 40 is in the nominal position shown in FIGS. 2, 3, and 7, no water flows from valve 54 into connector 66. However, when trigger 40 is activated, e.g., by displacing it along the path and swinging it upwardly, valve 54 directs water out of connector 66 and into a tube 68 that runs to spray nozzle 52. Tube 68 and hose 60 may be routed along bridging structure 32 and held in place by retainers, such as plastic clips 80.

Figure 9:
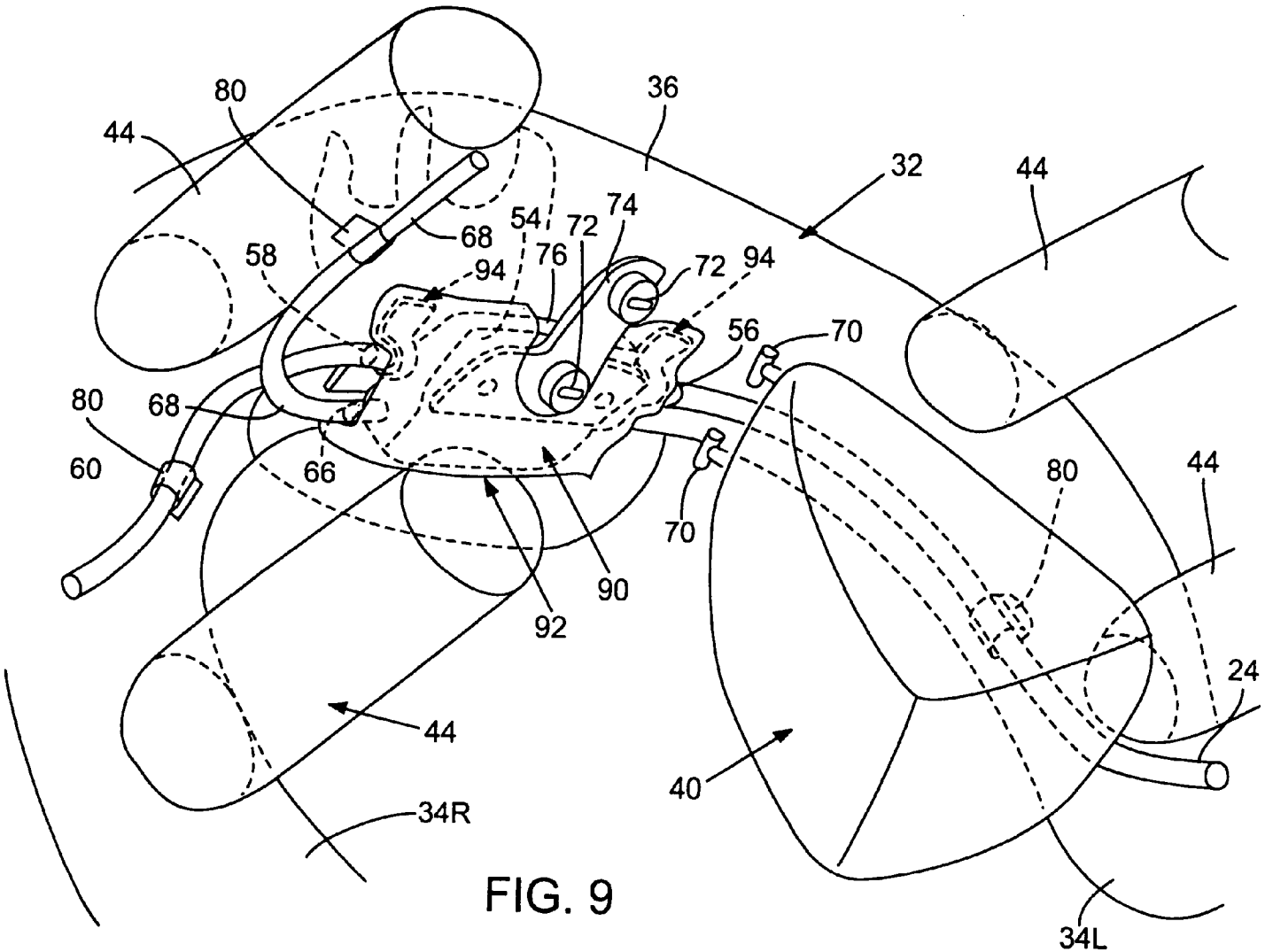
FIG. 9 is an isometric view of a portion of the bridging structure, shown from below looking upwards and to the front, showing the valve and a pair of tab-slot combinations for connecting the trigger to the valve.

Trigger 40 is preferably coupled to valve 54 as shown in FIG. 9 by a pair of T-shaped tabs 70 on trigger 40. Tabs 70 fit into a pair of slots 72 in a handle 74 on valve 54. The tab may be received in the slot in a first orientation, wherein the tab is aligned with the slot, and then rotated about 90-degrees to a second orientation which tends to retain the tab in the slot. Using a pair of tab-slot combination helps to prevent inadvertent rotation back to the first orientation.

Trigger 40 preferably controls the valve by rotating or by putting pressure on handle 74 relative to a main body 76 of valve 54. This pressure or rotation of handle 74 releases a diaphragm or other suitable fluid control device within valve body 76 to open a channel between input connector 58 and output connector 66 that is coupled to spray nozzle 52. Other suitable configurations for a valve controlled by a trigger may be used.

It is believed that the disclosure set forth above encompasses multiple distinct inventions with independent utility. While each of these inventions has been disclosed in its preferred form, the specific embodiments thereof, as disclosed and illustrated herein, are not to be considered in a limiting sense as numerous variations are possible. The subject matter of the inventions include all novel and non-obvious combinations and sub-combinations of the various elements, features, functions and/or properties disclosed herein. Where claims recite "a" or "a first" element or equivalent thereof, such claims should be understood to include incorporation of one or more such elements, neither requiring, nor excluding two or more such elements.

It is believed that the following claims particularly point out certain combinations and sub-combinations that are directed to one of the disclosed inventions and are novel and non-obvious. Inventions embodied in other combinations and sub-combinations of features, functions, elements and/or properties may be claimed through amendment of those claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

What is claimed is:

1. A waterslide for a user to slide on when the waterslide is coupled to a water source, the waterslide comprising:

a sliding surface providing a path along which the user slides in a sliding direction, said sliding surface being configured for use on a substantially flat, soft surface;

a sprinkler tube alongside the sliding surface for spraying water from the water source onto the sliding surface;

a hose coupler for connecting to the water source, and providing water to the sprinkler tube;

a valve coupled to the hose coupler for selectively providing water to a spray nozzle disposed adjacent the path;

a trigger coupled to the valve; and a bumper disposed near to said valve;

wherein said trigger is disposed adjacent the sliding surface so as to be activated by the user while sliding along the path in said sliding direction, said bumper being disposed between said user and said valve with respect to a user sliding along said sliding surface in a sliding direction, the trigger controlling the valve to direct water through the hose coupler to the spray nozzle to spray water onto the user.

2. The waterslide of claim 1 wherein the spray nozzle is disposed above the sliding surface to spray water downwardly onto the user when the user activates the trigger.

3. The waterslide of claim 1 wherein the sliding of the user along the path activates the trigger.

4. The waterslide of claim 1 further comprising a bridging structure spanning the path of the sliding surface.

5. The waterslide of claim 4 wherein the trigger hangs from the bridging structure.

6. The waterslide of claim 4 wherein the valve is mounted to the bridging structure.

7. The waterslide of claim 4 wherein the bridging structure is inflatable.

8. The water slide of claim 4 wherein the spray nozzle is mounted to the bridging structure.

9. The waterslide of claim 1 wherein the trigger is an inflatable plastic structure.

10. The waterslide of claim 1 wherein the spray nozzle is positioned farther in the direction of the user's sliding along the path than the trigger by at least about 10-inches.

11. The waterslide of claim 1 wherein the valve and the trigger include at least one cooperating combination of a slot and a tab, one of the slot and the tab disposed on the valve and the other of the slot and tab disposed on the trigger, whereby the trigger is coupled to the valve.

12. The waterslide of claim 11 wherein the tab has a T-shape, and is received in the slot in a first orientation and is rotated to a second orientation to be retained in the slot.

13. A waterslide for use on a substantially flat, soft surface, the waterslide including a sliding surface configured to be wetted with water, the sliding surface providing a path along which a user slides when the surface is wetted, the waterslide comprising: a bridging structure spanning the path; a valve coupled between the trigger and the spray nozzle; a bumper disposed so as to protect a user from direct contact with said valve; a trigger mounted to the bridging structure and hanging in the path of the user; and a spray nozzle mounted to the bridging structure and disposed to spray down onto the path, wherein the trigger causes the spray nozzle to spray the user with water by the trigger's being contacted by the user while sliding along the path and the trigger's being displaced along the path by the user's contact.

14. The waterslide of claim 13 wherein the valve is configured to be coupled to a water source, the trigger controlling the valve to direct water to the spray nozzle when the trigger is displaced along the path.

15. The waterslide of claim 14 wherein the valve and the trigger include at least one cooperating combination of a slot and a tab whereby the trigger is coupled to the valve.

16. The waterslide of claim 15 wherein the tab has a T-shape, and is received in the slot in a first orientation and is rotated about 90-degrees to a second orientation to be retained in the slot.

17. The waterslide of claim 13 wherein the bridging structure is inflatable.

18. The waterslide of claim 13 wherein the trigger is an inflatable plastic structure.

19. The waterslide of claim 13 wherein the spray nozzle is separated from the trigger along the path by at least about 10-inches.

20. The waterslide of claim 13, wherein said bridging structure is removably attached to said sliding surface, effective that said bridging structure may be attached to said sliding surface at a plurality of positions.

21. A slide providing a sliding surface along which a user slides, the slide comprising: a bridging structure spanning the sliding surface; a valve for coupling to a source of water, the valve mounted to the bridging structure; a bumper disposed near said valve effective to prevent direct contact between said user and said valve; a spray nozzle selectively coupled through the valve to the water source, the spray nozzle mounted to the bridging structure to spray water toward the sliding surface when the valve couples the nozzle to the water source; and a trigger hanging from the bridging structure adjacent the sliding surface and coupled to the valve, the trigger controlling the valve to direct water to the spray nozzle when the trigger is contacted and displaced by the user.

22. The slide of claim 21, wherein said bridging structure is removably attached to said sliding surface, effective that said bridging structure may be attached to said sliding surface at a plurality of positions.

23. The slide of claim 21, wherein said bridging structure is removably attached to said sliding surface, effective that said bridging structure may be attached to said sliding surface at a plurality of positions.

* * * * *